US005130701A

United States Patent [19]

White et al.

[11] Patent Number: 5,130,701

[45] Date of Patent: Jul. 14, 1992

[54] DIGITAL COLOR REPRESENTATION

[75] Inventors: James M. White; Vance Faber; Jeffrey S. Saltzman, all of Los Alamos, N. Mex.

[73] Assignee: The United States of America as represented by the United States Department of Energy, Washington, D.C.

[21] Appl. No.: 350,675

[22] Filed: May 12, 1989

[51] Int. Cl.[5] ..... G09G 1/28

[52] U.S. Cl. ..... 340/701; 340/703; 358/133; 358/81

[58] Field of Search ..... 340/701, 702, 703; 358/80, 81, 133; 364/521

[56] References Cited

U.S. PATENT DOCUMENTS

| | | | |
|---|---|---|---|
| 4,580,134 | 4/1986 | Campbell et al. | 340/703 |
| 4,710,806 | 12/1987 | Iwai et al. | 340/703 |
| 4,717,954 | 1/1988 | Fujita et al. | 358/80 |
| 4,743,959 | 5/1988 | Frederiksen | 358/133 |
| 4,751,446 | 6/1988 | Pineda et al. | 340/703 |
| 4,843,573 | 6/1989 | Taylor et al. | 340/701 |
| 5,003,299 | 3/1991 | Batson et al. | 340/703 |

OTHER PUBLICATIONS

P. Heckbert, "Color Image Quantization for Frame Buffer Display," 16 Computer Graphics No. 3, pp. 297-306 (Jul. 1982).

Y. Linde et al., "An Algorithm for Vector Quantizer Design," COM-28 IEEE Trans. Comm. No. 1, pp. 84-95 (Jan. 1980).

*Primary Examiner*—Ulysses Weldon
*Assistant Examiner*—M. Fatuhi-Yar
*Attorney, Agent, or Firm*—Ray G. Wilson; Paul D. Gaetjens; William R. Moser

[57] ABSTRACT

An image population having a large number of attributes is processed to form a display population with a predetermined smaller number of attributes which represent the larger number of attributes. In a particular application, the color values in an image are compressed for storage in a discrete lookup table (LUT) where an 8-bit data signal is enabled to form a display of 24-bit color values. The LUT is formed in a sampling and averaging process from the image color values with no requirement to define discrete Voronoi regions for color compression. Image color values are assigned 8-bit pointers to their closest LUT value whereby data processing requires only the 8-bit pointer value to provide 24-bit color values from the LUT.

10 Claims, 4 Drawing Sheets

Microfiche Appendix Included
(1 Microfiche, 15 Pages)

DIGITAL COLOR REPRESENTATION

This invention is the result of a contract with the Department of Energy (Contract No. W-7405-ENG-36).

MICROFICHE APPENDIX

A microfiche appendix forms a part of the following description, having 1 microfiche with 15 frames. The microfiche appendix contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF INVENTION

This invention relates to vector quantization and, more particularly, to methods for forming a lookup table having a predetermined number of attributes representing a larger number of attributes of a defined population.

The field of vector quantization generally concerns the representation of a large number of specified attributes of a given population with a smaller number of attributes which are distributed over the population to approximate the distribution of the large number of attributes. In the following discussion, the population is pixels of a video display system and the attributes are colors to be associated with the pixels. It will be understood that the processes described herein are applicable to any population which can be described by specified attributes such that the term pixel means any specified population and the term color means any selected set of attributes.

A display system for a video system, e.g. a data processing system, displays discrete colors at individual pixels. The color represented at each pixel is typically formed from a plurality of phosphors, each generating a specific color amplitude response to an activating electron beam. A typical set of phosphors may represent the primary colors red, blue, and green, from which a complete color spectrum may be formed. High resolution digital representations of color images present twenty four bit words, eight bits each for the three colors, to encode the color to be presented. This representation provides over 16 million discrete colors.

A twenty four bit color representation, however, is beyond the capability of most display systems, particularily where a real-time video capability is desired. A conventional display system uses only an eight bit word for color representation, which enables 256 colors to be selected to represent an image. The eight bit word does not, however, directly represent a color, but an address in a look-up table (LUT). The LUT then contains twenty four bit representations at each of the 256 addresses. The display system assigns each actual color to one of the stored colors in the LUT and the stored color is actually used to generate the color displayed by each pixel during the raster generation of a color display. U.S. Pat. No. 4,751,446, issued Jun. 14, 1988, to Pineda et al., incorporated herein by reference, describes one embodiment of a LUT for providing color data to a video display.

To present a high resolution color image, an optimum set of colors must be selected to represent the image. A method that will compress a color image for LUT decompression will have the following features:

1. It must produce from a list of colors in the original image a second smaller list of colors (the representative LUT colors); the representative colors need not be present in the original image.
2. It must replace each of the original colors with an index into the LUT.

In one approach to color image quantization, a fixed set of color representations are stored in the LUT. The fixed set of colors may be uniformly spaced or may be based on a statistical distribution of the input colors. A uniform quantization is computationally fast, but provides poor color representations: In a statistical distribution representation, an algorithm must be selected to map the image colors onto the LUT to adequately represent the distribution of actual image colors.

A number of algorithms have been applied for this color mapping, some of which are discussed in P. Heckbert, "Color Image Quantization for Frame Buffer Display," 16 Computer Graphics, No.3, pp. 297-302 (Jul. 1982), incorporated herein by reference. In one algorithm, the densest regions in the image color distribution are selected to form the LUT. This algorithm apparently does not perform well on images with a wide variety of colors or with a small number of colors. Other algorithms attempt to define volumes in the color space, i.e., Voronoi regions, and select colors from those volumes, either as volume averages or as centroids of the volumes. Substantial computing time is required to define and iterate the Voronoi volumes.

The difficulty of selecting an optimum set of color representations for the LUT is particularly apparent in a video display having multiple windows, where multiple screens are displayed, with one screen selected for processing. The selected screen determines the LUT representations according to prior art methods. Accordingly, the selected screen may have adequate color definition, but the remaining screens typically have poor color definition since their color definition has been determined by the selected screen.

These and other problems of the prior art are addressed by the present invention wherein a LUT color representation is found without the need for defining Voronoi regions in color space suitable for color selection.

Accordingly, one object of the present invention is to generate a high resolution color representation of an image without defining Voronoi regions in the color space distribution defined by that image.

It is another object of the present invention to provide a method for quantizing color for a LUT which operates on rapid sequential displays in real time.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purposes of the present invention, as embodied and broadly described herein, the method of this invention may comprise generating a LUT color representation of an image without segregating volumes in the color space defined by the image. An initial set of LUT values is determined by selecting colors from the image with equal probability. The image is then sampled for colors with equal probability and each sampled color is averaged with the closest representation in the LUT to form a new representation to replace the stored representation. The sampling continues until predetermined limits are reached, e.g. a selected number of samples have been made and/or the errors between the sampled image colors and the stored color representations are reduced to selected values. Each image pixel is then indexed to a color representation address in the LUT which most closely represents the image pixel color. Thus, each pixel is addressed to its assigned color as the image is scanned for display.

In a particular embodiment of the present invention, the image colors are assigned to LUT addresses using an adaptive algorithm to determine nearest neighbors whereby the densest color space, as defined by the LUT, provides the largest number of refinement cubes from which a small number of possible nearest neighbors can be selected for comparison with an actual image color. Each pixel value does not have to be compared with the entire LUT array to index each pixel to its nearest representative color value in the LUT.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawing.

DETAILED DESCRIPTION OF THE INVENTION

Figure 1A:
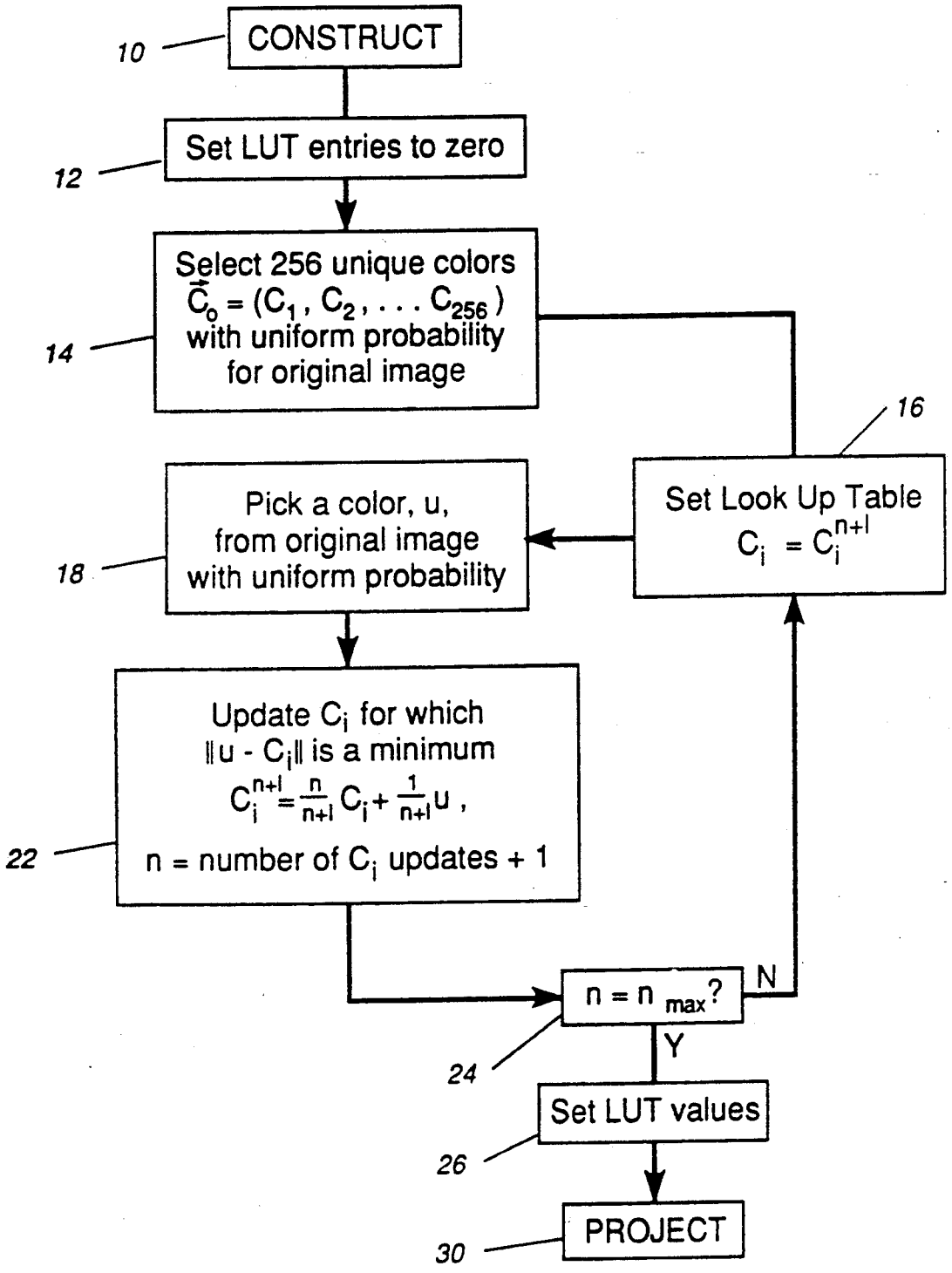
FIG. 1A is a block flow diagram for forming a LUT suitable to display a selected color image.

It has been found, according to the present invention, that Monte Carlo sampling techniques can be used to directly form the LUT for image color representation without any need to directly compute Voronoi regions, i.e. regions enclosing image colors which are nearer to a given LUT color representation than any other LUT color representation. The following steps are required to form the LUT:

1. Pick 256 unique colors $c_0=(c_1,c_2, \ldots c_{256})$ with uniform probability from the original image.
2. Pick one color, u, from the original image with uniform probability.
3. Update the color $c_i$ for which the distance between u and $c_i$, i.e., $|u-c_i|$, is minimum by computing a weighted average, e.g. $c_i^1=(n/n+1)c_i+(1/n+1)u$, where n is the number of times that $c_i$ has been previously updated plus one.
4. Return to 2.

The image sampling and LUT updating are continued until some selected criterion is obtained, e.g. a predetermined number of samples have been taken or the LUT color representations remain within predetermined limits for successive updates. By reference to sampling with uniform or equal probability is meant the random selection of image locations from which a color is obtained.

Once the LUT is formed, each color in the image is indexed to its closest $c_i$. It is believed that these assignments may be equivalent to forming the Voronoi regions of the prior art but without explicitly computing the regions, which is a very time consuming computational step.

In order to index the image colors into the LUT color representations, a nearest LUT color must be found for each actual image color. The problem can be expressed as follows: Given a set of color arrays $$r_i g_i b_i \; 0 \leqq i < N_p$$

called the pixel set, and $$r'_j r'_j r'_j \; 0 \leqq j < Nt \leqq 256$$

called the lookup table, find a new color array $$c_i, \; 0 \leqq i < N_p$$

such that for each i $c_i = j_m$, where $r'_{jm}, g'_{jm}, b'_{jm}$ satisfies $$\min D(r'_j g'_j b'_j r_i g_i b_i) \text{ for } 0 \leqq j < N_t$$

and $$D(r'_j g'_j b'_j r_i g_i b_i) = (r'_j - r_i)^2 + (g'_j - g_i)^2 + (b'_j - b_i)^2$$

For the video application described, $r'_j, g'_j, b'_j, r_i, g_i, b_i$ and $c_i$ are all integers in the interval [0,255], but the technique does not depend on this restriction.

In one embodiment of the present invention, this replacement of actual image values with an index to the closest LUT values is done using an adaptive algorithm rather than a one-by-one computation. It will be appreciated that both the lookup table and the pixel set are contained in a cube with each side having length 256. If this cube is subdivided into eight equal cubes, the LUT values nearest every interior point in each of the refined cubes can now be determined. The cubes are adaptively refined to define a number of cubes each having a maximum number of LUT values associated with a cube. The pixel values in the interior of each cube have to be compared with only the reduced number of LUT values most closely associated with that cube rather than the entire LUT. A tree structure is formed from the cubes that is easily traversed.

As hereinafter described, the closest LUT values are the smallest subset of points in the LUT closer to every point of the cube than the complement of this subset. First, the LUT is copied into a temporary list, L. Then a value in the list, L, is found closest to the centroid of a selected subcube, $p_j=(r'_j, g'_j, b'_j)$, and stored in a list, M, as one member of a list of points nearest to the subcube. It is then determined for each of the remaining points, $p_k$, in the list, L, whether the selected subcube all lies within the half plane formed by $p_j$ and $p_k$ and nearest to $p_j$, i.e., to determine those points, $p_k$, nearer the cube corners than point $p_j$. If so, $p_k$ is added to the list, M, for further consideration. The list M is the desired list of points for the selected subcube, i.e. a new, smaller LUT for the image colors located in the subcube.

Referring now to FIG. 1A, there is shown a flow diagram for a function labeled CONSTRUCT 10 which takes a data structure describing a twenty-four bit image and returns a lookup table containing twenty four bit color representation values effective to form a high resolution color image from an eight bit index representation. CONSTRUCT 10 takes a data structure describing a twenty four bit image and returns a lookup table containing color values that can best be used to reconstruct a color image and which are addressable by an eight bit pointer. The twenty four bit image is described with the first four arguments of the function data structure. The first three variables point to arrays that are the intensities for the red, green, and blue components of the twenty four bit image. These arrays are unsigned characters with a range from 0 to 255 inclusive. The fourth argument of the data structure is an integer giving the number of pixels in the image.

The next four arguments of the data structure constitute the description of the lookup table. The first three arguments point to arrays that are unsigned characters, where the arrays contain red, green, and blue intensities in the range of 0 to 255. The fourth argument is an integer giving the number of desired entries in the lookup table. The second to last entry is a pointer to an array of integers having the same size as the lookup table arrays. The last entry in the data structure is an integer specifying the number of iterations the algorithm should use in finding the lookup table. Upon completion of the function call, the function value returned is the number of distinct elements in the lookup table. This number is generally the number specified in the function call, but may be a smaller number if fewer colors are found after the specified number of samples.

When CONSTRUCT 10 is called, the existing LUT entries are set 12 to zero. The desired color image is digitized and is sampled 14 with uniform probability to select an initial set of 256 unique colors which form 16 the LUT. An iteration loop is now established to better represent the actual image colors in the LUT. The image colors are sampled 18 with equal probability to obtain a series of color samples, u. For each color, u, the closest LUT representation is found and updated 22 to form a replacement LUT representation. The updated value is an average of the LUT value and the sampled image value with the sample value weighted as one divided by the number of samples plus one. In one embodiment, the LUT value is weighted as one minus the sample weight. The iteration loop continues until a selected number of samples 24 have been taken. It will be appreciated that later samples will have progressively less effect on the stored LUT values.

Figure 1B:
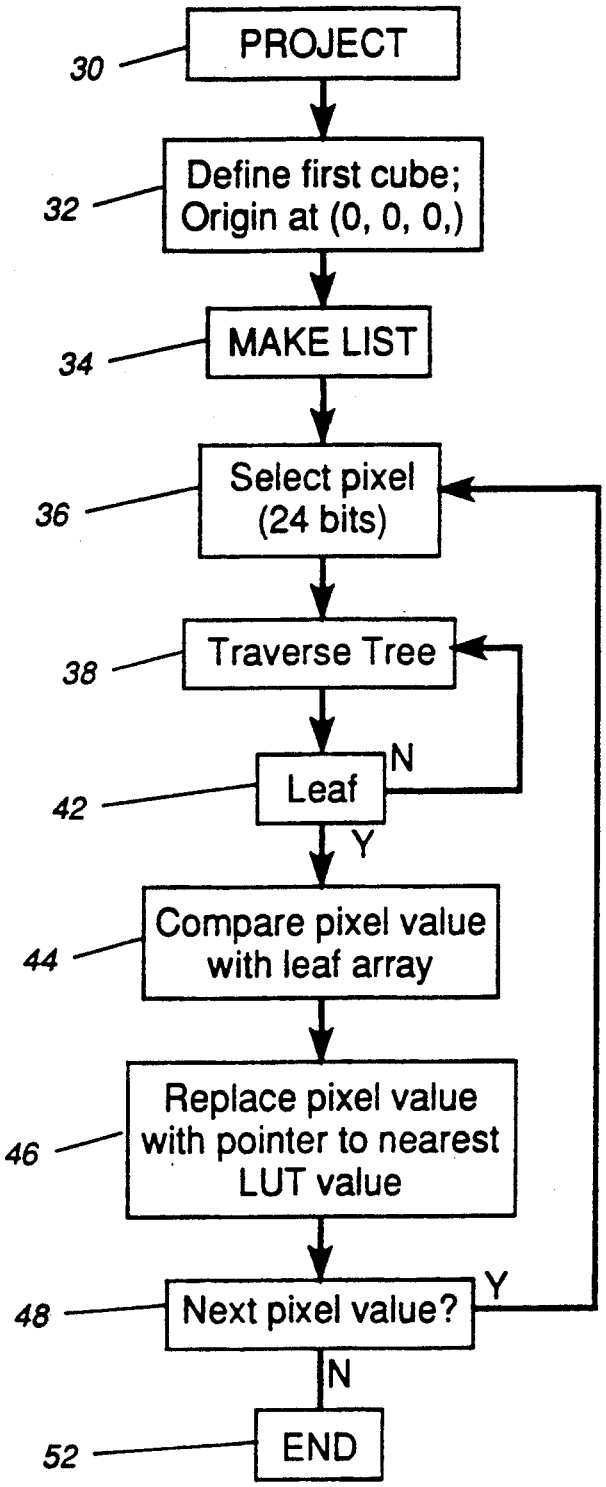
FIG. 1B is a block flow diagram for reconstructing a color image from the LUT formed in FIG. 1A.

Once the selected number of samples 24 has been taken, the LUT values are set 26 and PROJECT 30 is called for replacing the image colors with pointers into the LUT. Referring now to FIG. 1B, there is shown a flow chart for function call PROJECT 30, which builds an eight bit image from a twenty four bit image and a lookup table. For each pixel in the twenty four bit image, PROJECT 30 finds the closest value in the lookup table and stores the index of that value in the output array. The twenty four bit image is described with the first four arguments in the data structure of PROJECT 30. The first three variables point to arrays that are the intensities for the red, green, and blue components of the twenty four bit image. These arrays are unsigned characters with a range from 0 to 255 inclusive. The fourth argument of the function data structure is an integer giving the number of pixels in the image.

The next four arguments of the function constitutes a data structure for the description of the lookup table. The first three arguments point to arrays that are unsigned characters and contain the red, green, and blue intensities in the range of 0 to 255. The fourth argument is an integer giving the number of entries in the lookup table. The last argument of the function call points to an array used to describe the generated eight bit image. This array is a collection of unsigned characters used as pointers from a pixel location to an entry in the lookup table. To find the eight bit color of a pixel at the n'th location in the pixel image, the number in the n'th location of the pointer array is found and that pointer number is used as the color index to the LUT.

In order to efficiently construct the eight bit pixel image, PROJECT 30 creates a tree structure from the LUT to quickly find the nearest entry in the LUT for a given pixel value from the twenty four bit image. Each node of the structure corresponds to a cube in red-green-blue space. A data structure is associated with each cube and contains four short integers, an array of eight pointers pointing to other cubes and another pointer pointing to an array of indices if the cube is also a leaf of the tree. The first three integers specify the absolute origin of the cube and the fourth integer specifies whether the cube is a leaf of the tree or provides pointers to eight other cubes.

PROJECT 30 first defines 32 a cube in color space having its origin at (0,0,0). The function MAKELIST 34 (see FIG. 1C) is called to recursively build the tree structure of cubes which is later traversed by PROJECT 30 to find the entry in the LUT nearest to a given pixel. MAKELIST 30 examines each cube to determine whether the cube should be further refined, i.e. subdivided, by calling itself, or whether the LUT values within the cube should be stored and another cube examined.

Once MAKELIST 34 has defined a tree, PROJECT 30 selects 36 a pixel from a location in the pixel array and the tree is traversed 38 until a leaf is reached 42. i.e. a cube which contains the pixel. The pixel color value is then compared 44 only with the leaf array to find the closest array value. The pixel image color value is replaced 46 by the pointer argument associated with the array value. It will be appreciated that this comparison between pixel image colors and LUT colors involves only a few LUT colors which have been associated with the leaf cube. The pixel selection loop is repeated 48 until all of the twenty four bit image values have been replaced with eight bit pointers to the LUT.

Figure 1C:
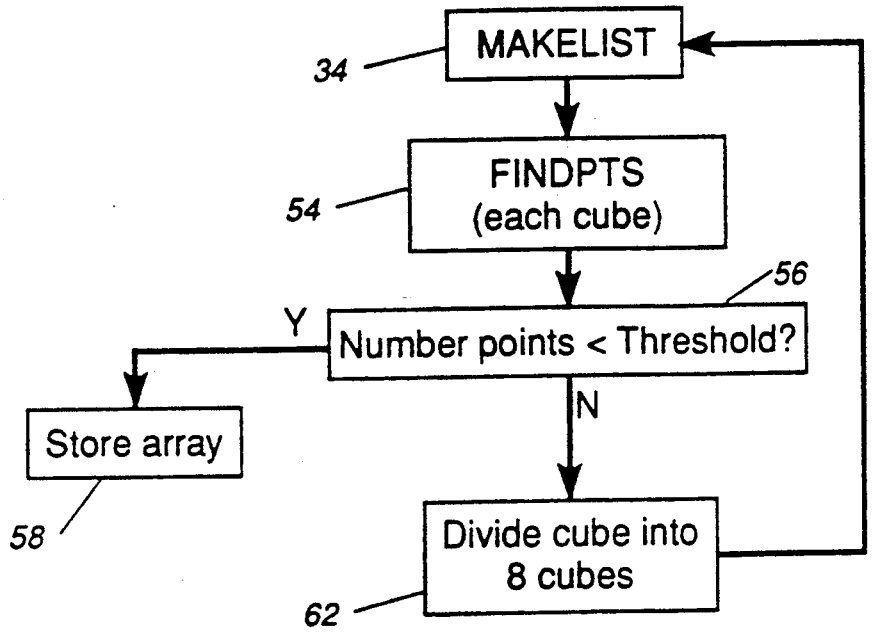
FIG. 1C is a subroutine for FIG. 1B for defining cubes in color space.

The function MAKELIST 34 refines the cube structure in the manner shown in FIG. 1C so that each defined cube has only a minimum number of LUT values nearest to interior points of the cube. As each cube is presented to MAKELIST 34, the function FINDPTS 54 (see FIG. 1D) is called to determine the number of LUT values nearest to interior points of the cube. If the number of LUT values is determined 56 to be less than a selected threshold the array of color values found by FINDPTS 54 is stored for that cube. If the number of LUT values is greater than the threshold, the cube is refined, i.e. subdivided, 62 into eight smaller cubes and MAKELIST 34 is called recursively for each cube until the tree structure is defined.

Figure 1D:
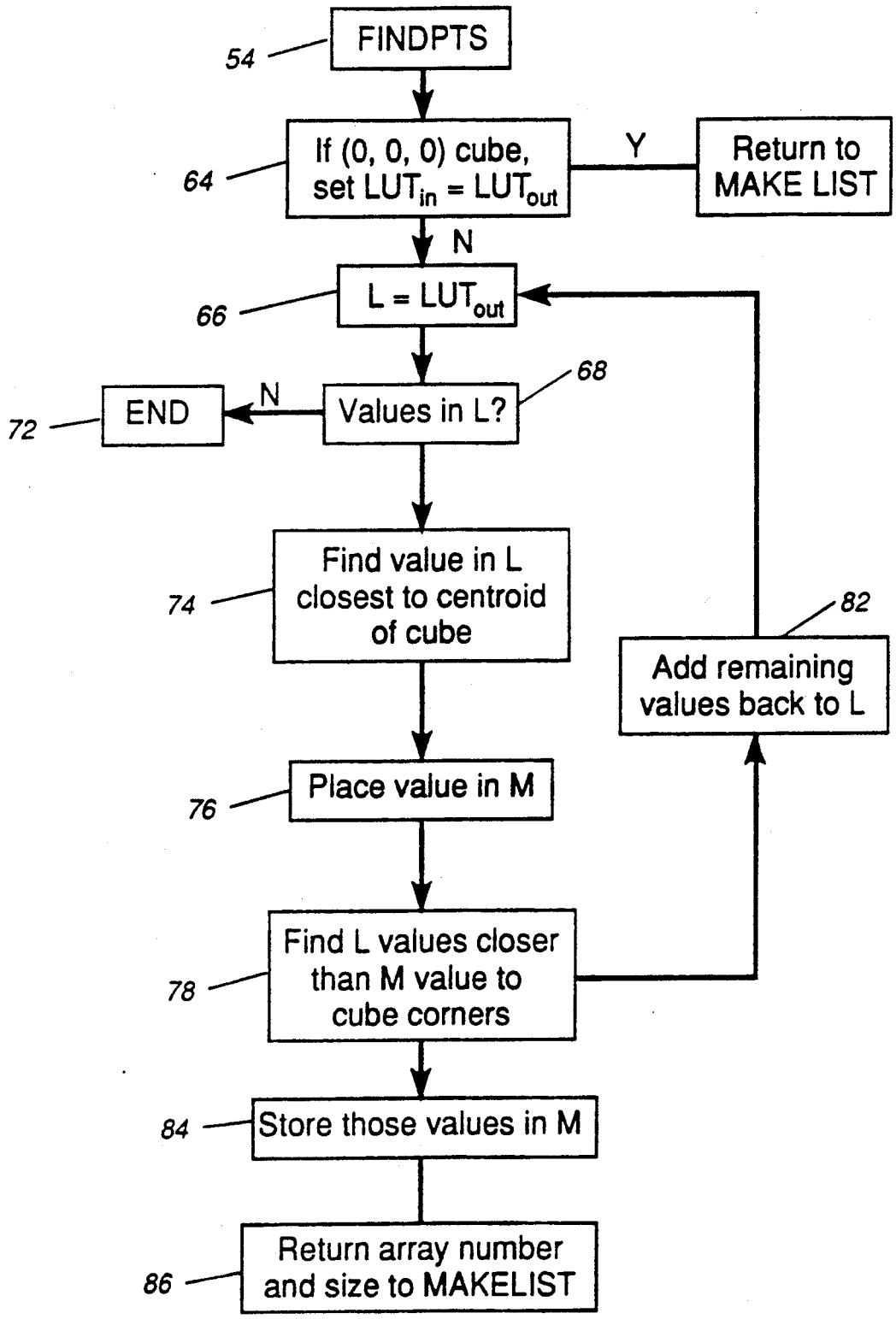
FIG. 1D is a subroutine for FIG. 1B for determining the nearest LUT values to the interior of the cubes defined in FIG. 1C.

Referring now to FIG. 1D, the function FINDPTS 54 is called to find the LUT values which are closer to the defined cube than any other values and returns an array with those points. If the cube to be evaluated is the initial cube 64, the program returns to MAKELIST 34 for the cube to be refined. Otherwise, an initial list L is established 66 having the values from the original LUT. For each cube from MAKELIST 34 a value in L is found 74 which is nearest the centroid of the cube and this value is placed 76 in a list M. The list L is then examined 78 for values which are closer to the cube corners than the centroid approximation stored in M. All of the closer values which are found in L are placed 84 in array M for storage. The remaining values are placed 82 back in list L for examination. The array M number and size is returned to MAKELIST 34 to determine whether array M is stored in the tree or is further refined.

Thus, function call CONSTRUCT 10 defines a set of LUT values to represent the actual image colors. Using function calls FINDPTS 54 and MAKELIST 34, a tree structure is defined to locate the LUT values in the image color space. Then, function call PROJECT 30 can traverse the tree structure with each image pixel value to find the closest LUT value. PROJECT 30 assigns a pointer 46 described by an 8-bit number to relate each image pixel value to a LUT value. A display of the image is then created using the LUT values by converting each image pixel color value in a conventional manner to a display pixel color value through the assigned 8-bit pointers.

For further analysis of the resulting display, no further pixel manipulation is needed, since the above sequence has obtained an accurate compression of the image pixel colors into the LUT colors. However, the resulting visual representation can have a contoured appearance arising from the assignment of some range of color values.

If it is desired to improve the esthetic appearance of the display, a spatial integration algorithm, or dithering, can be introduced in PROJECT 30. A true spatial integration can provide two desirable improvements in the resulting display. First, the technique globally averages the image attributes whereby the display has overall average attributes which match the image. Secondly, local anomalies are reduced. The integration provides several LUT color values in a local area whose average more closely approximates the image color value than a single LUT value. Further, in a region where the LUT value changes, i.e., a contour line, the integration mixes the adjacent LUT values to smooth out the apparent contour line. In one embodiment, the pointer array (FIG. 1B, PROJECT 30, steps 36–48) is formed by including additional steps to find the error between an image pixel value and its corresponding LUT value, and incrementing the next image pixel value by the error before finding the corresponding LUT value.

A program listing to accomplish the flow diagram shown in FIGS. 1A–1D is depicted in the attached microfiche appendix. The program includes a subroutine for dithering during the process for forming the pointer array to compress the image attributes to the LUT attributes.

While the above process has generally been described in terms of the color attributes (red, green, and blue) of a pixel population, it has obvious application to any set of attributes selected to represent a certain population. For example, a high resolution black and white image can be simulated on low resolution video monitors. Further, the construction of the lookup table is sufficiently rapid to support a real time video display as the speed of the image correlation algorithm is improved.

The foregoing description of the preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for generating a compressed representation of image pixel colors using stored color values in a lookup table (LUT) to form display pixel colors, comprising the steps of:

sampling said image pixel colors with equal probability to generate a first set of said stored color values;

sampling said image pixel colors with equal probability to generate a sequence of actual image colors;

determining a closest one of said stored color values to each of said actual image colors;

forming an average color value from said closest one of said stored color values and said actual image color; and updating said closest one of said stored color values with said average color value.

2. A method according to claim 1, wherein forming said average color value includes the step of weighting said closest color value with a weighting factor functionally related to the number of times said closest color value has been updated.

3. A method according to claim 2, where said weighting factor for said stored color value is the number of times said stored color value has been updated divided by one plus the number of updates.

4. A method according to claim 3, further including the step of weighting said sampled image color value by a factor one minus said weighting factor for said stored color value.

5. A method according to claim 1, wherein said image pixel colors are sampled a predetermined number of times to form a final LUT from said averaged color values effective to form a color display approximating said color image.

6. A method according to claim 5, wherein the step of forming said color display includes determining for each pixel color in said image an address in said final LUT of the closest stored color value.

7. A method according to claim 6, further including the step of refining a color space containing said stored color values into a plurality of adaptive volumes in said color space wherein each said adaptive volume defines a predetermined maximum number of said LUT stored color values which are closest to interior points of said volume.

8. A method for generating a compressed representation of image pixel colors using stored color values in a lookup table (LUT) to form display pixel colors, comprising the steps of:

sampling said image pixel colors with equal probability to generate a first set of said stored color values;

sampling said image pixel colors with equal probability to generate a sequence of actual image colors;

selecting a closest one of said stored color values to each of said actual image colors;

forming an average color value from a weighted value of said closest one of said stored color values with a weighting factor functionally related to the number of times said closest color value has been selected and from said actual image color;

updating said closest one of said stored color values with said average color value, wherein said image pixel colors are sampled a predetermined number of times to form a final LUT from said averaged color values effective to form a color display approximating said color image; and determining for each pixel color in said image an address in said final LUT of the closest stored color value to represent said image pixel color as said display pixel color.

9. A method according to claim 8, further including the step of refining a color space containing said stored color values into a plurality of adaptive volumes in said color space wherein each said adaptive volume defines a predetermined maximum number of said LUT stored color values which are closest to interior points of said volume.

10. A method according to claim 9, where said weighting factor for said stored color value is the number of times said stored color value has been updated divided by one plus the number of updates and said sampled image color value is weighted by a factor one minus said weighting factor for said stored color value.

* * * * *